United States Patent [19]

Gonzalez

[11] 3,978,671

[45] Sept. 7, 1976

[54] DUPLEX ENGINE OIL SEPARATOR

[75] Inventor: Cesar Gonzalez, Wichita, Kans.

[73] Assignee: The Cessna Aircraft Company, Wichita, Kans.

[22] Filed: Oct. 15, 1974

[21] Appl. No.: 514,764

[52] U.S. Cl. ..... 60/598; 55/171; 55/187; 55/319; 55/DIG. 19; 55/DIG. 25; 123/41.86; 123/119 B; 123/196 A; 184/6.24

[51] Int. Cl.[2] ..... F02B 33/44

[58] Field of Search ..... 55/171, 183, 185, 186, 55/187, 319, 419, 428, 446, DIG. 19, DIG. 25, DIG. 28, 182, 188, 445, 418; 123/119 B, 196 A, 1 R, 41.86; 184/6.23, 6.24; 60/598; 210/23 R

[56] References Cited

UNITED STATES PATENTS

| | | | |
|---|---|---|---|
| 1,552,866 | 9/1925 | Miller | 55/419 X |
| 2,302,807 | 11/1942 | Shoeld | 55/182 X |
| 2,493,617 | 1/1950 | Chubbuck | 55/DIG. 19 |
| 2,639,779 | 5/1953 | Glanzer | 55/187 |
| 2,747,514 | 5/1956 | Edwards | 184/623 X |
| 3,558,482 | 1/1971 | DeYoung | 210/23 R |
| 3,678,661 | 7/1972 | Davis | 55/DIG. 25 X |

*Primary Examiner*—Frank W. Lutter
*Assistant Examiner*—David L. Lacey
*Attorney, Agent, or Firm*—Edward L. Brown, Jr.

[57] ABSTRACT

A dual air-oil separator which separates two air-oil mixtures of differing proportions in a single unit having first and second chambers for the separate mixtures. The two chambers are separated by a perforated partition wall. The air-oil mixture, high in air is separated as it passes from the first chamber through the perforated wall and into the second chamber. The second chamber directly receives the air-oil mixture, low in air, for separation and combination in its sump with the oil from the first chamber.

5 Claims, 5 Drawing Figures

DUPLEX ENGINE OIL SEPARATOR

BACKGROUND OF THE INVENTION

This invention relates to separating oil from air-oil mixtures, more particularly engine oil from air and other gases and especially separating, in a single unit, air-oil mixtures of differing proportions. An example is an air-oil separator which takes the lubricating oil discharge from a turbocharger and the mist from the crankcase vent and collects the deaerated oil in the separator sump while air and gases are vented. It is obviously advisable to separate the gases from the oil before recirculating the oil.

Prior practice is to feed the turbocharger oil direct to the engine-driven pump without separation or to use two separators. The problem with feeding the oil direct to the pump is that high time engines under idle or low power conditions overtax the pump with blow-by gases from both the engine and the turbocharger. Also, under high power conditions on low time engines the pressure at the pump inlet may exceed the pressure in the crankcase, especially at high altitudes. This causes flooding of the breather separator. The addition of another separator for the turbocharger oil results in deaerating the turbocharger oil but does not solve the breather separator's overflow flooding under high power conditions.

U.S. Pat. Nos. 2,639,779 and 2,925,878 show separators which include two stages of separation but only a single inlet which results in all proportions of gas-liquid mixtures passing through both stages successively. The earlier patent is adapted to air-oil mixtures low in air while the later patent is adapted to mixtures high in air. The elements and purpose in this prior art are different than those in this invention.

SUMMARY OF THE INVENTION

An object of this invention is to deaerate two types of air-oil mixtures, the one low and the other high in air content, within a separator which vents the air and feeds the deaerated oil to the pump. Where the word "air" is used in this application, it is meant to include blow-by gases.

The invention is an air-oil separator which efficiently separates oil from mixtures high in air content, as well as from mixtures low in air content, combining the deaerated oil from both sources in a common sump. The mixture high in air content is introduced into a first chamber having a perforated wall which serves to coalesce minute particles of oil on its surface down which the oil flows while the air passes through the perforations to a vent. The other mixture, which is low in air content, is introduced into a second chamber where the air-oil mixture separates by gravity. Reduced velocity, of course, assists separation in both chambers. The perforated wall is between the two chambers permitting a common sump for the deaerated oil from both chambers. The two chambers also have a common exhaust or overflow vent which is located in the upper part of the second chamber.

DETAILED DESCRIPTION OF THE INVENTION

Figure 1:
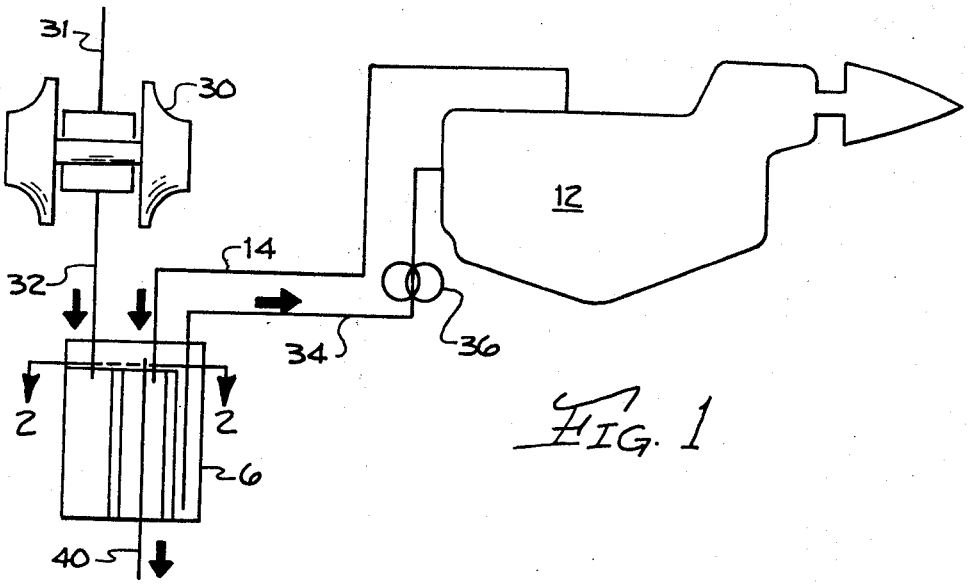
FIG. 1 is a diagrammatic drawing of the separator showing its relationship with other elements in the system.

The preferred embodiment will be described as it applies to a duplex separator used with an aircraft engine. Referring to FIG. 1, the separator 6 receives the air-oil mixture, high in air, from the engine crankcase 12 through crankcase vent conduit 14 and the air-oil mixture, low in air, from turbocharger 30 through turbo oil drain conduit 32. Sump drain conduit 34 carries the separated deaerated oil to scavenge pump 36 which pumps it back to crankcase 12. Through lines and pump, not shown but well known in the art, oil is pumped from crankcase 12 to turbocharger 30 through turbo oil supply conduit 31. Exhaust vent conduit 40 in separator 6 provides a vent for the separated air and serves as an emergency oil vent. If separator 6 overfills with oil, exhaust vent conduit 40 conducts the oil to a point outside the aircraft.

Figure 2:
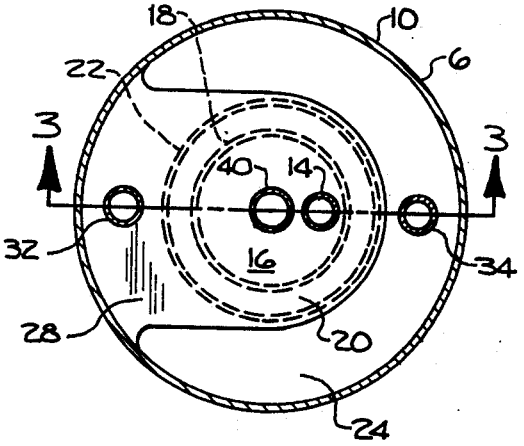
FIG. 2 is a horizontal section through the separator on line 2—2 of FIGS. 1 and 3.
Figure 3:
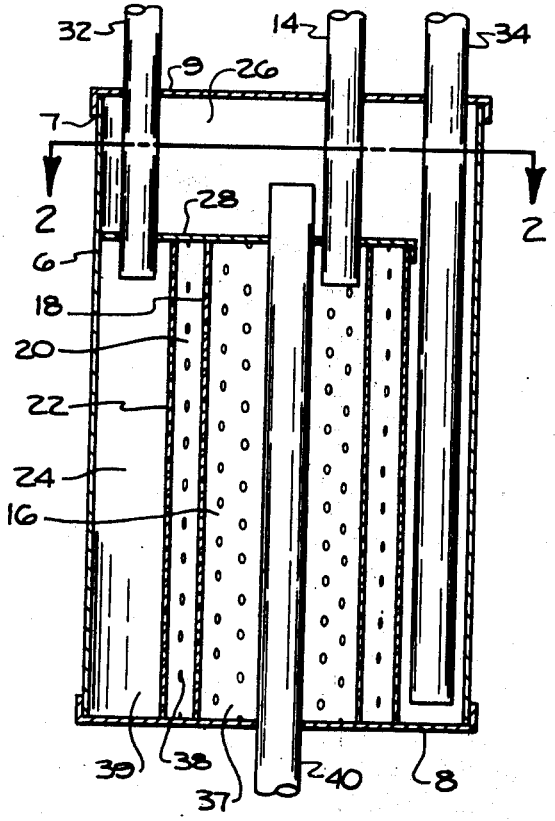
FIG. 3 is a vertical section through the separator on line 3—3 of FIG. 2.

The elements of the separator 6 are more plainly shown in FIGS. 2 and 3. FIG. 2 is a horizontal section, looking down, just below separator top 9. FIG. 3 is a vertical section through separator 6 showing its elements. Directing attention to FIG. 3, separator 6 is enclosed by shell 10, bottom 8, and top 9, these enclosures comprising housing 7. The first separator chamber 16 is enclosed by a perforated inner partition wall 18, bottom 8 and baffle 28. Crankcase vent conduit 14 conveys its air-oil mixture to first chamber 16. Intermediate separator chamber 20, lying between inner partition wall 18 and perforated outer partition wall 22, is further enclosed by bottom 8 and baffle 28. The second separator chamber 24 lies outside of outer partition wall 22 and is further enclosed by shell 10, bottom 8 and top 9. Baffle 28 covers the top of first chamber 16 and intermediate chamber 20. Upper portion 26 of second chamber 24 is above baffle 28 and below top 9. Upper portion 26 is an extension of and communicates with second chamber 24. First chamber sump 37 is at the bottom of first chamber 16, intermediate chamber sump 38 is at the bottom of intermediate chamber 20 and second chamber sump 39 is at the bottom of second chamber 24. Turbo oil drain conduit 32 leads from turbocharger 30 to second chamber 24. Sump drain conduit 34 leads from second chamber sump 39 through scavenge pump 36 to crankcase 12. Perforations in partition walls 18 and 22 also connect sumps 37 and 38 to sump 39.

Figure 5:
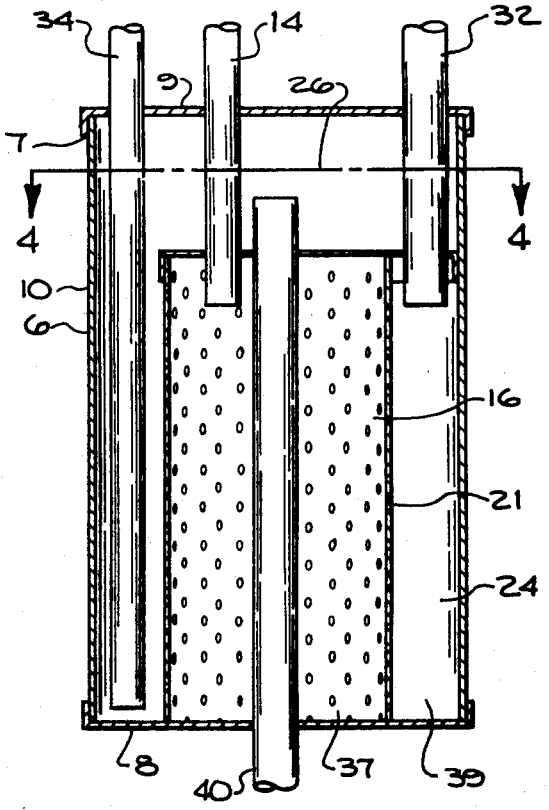
FIG. 5 is a vertical section through the modified form of separator on line 5—5 of FIG. 4.
Figure 4:
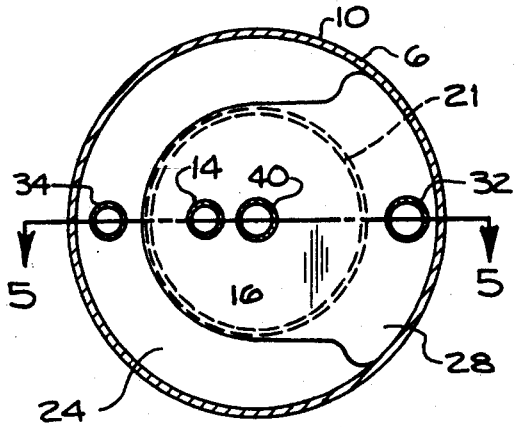
FIG. 4 is a horizontal section similar to FIG. 2 through a modified form of separator.

A modified embodiment of this separator is shown in FIGS. 4 and 5. The modification has a single partition 21 in place of the inner and outer partition walls 18 and 22. Therefore, there is no intermediate separator chamber 20.

MODE OF OPERATION

The oil mist which is vented from engine crankcase 12 through crankcase vent conduit 14 to first separator chamber 16 is slowed by the enlargement in cross-sectional area, and droplets of oil collect on the interior surfaces of first chamber 16 including the perforated inner partition wall 18 while the air passes through the perforations in wall 18. Droplets coalesce into drops and run down the sides of wall 18 to collect at the bottom in first chamber sump 37. Further similar separation occurs in intermediate separation chamber 20 which has two perforated walls, the inner wall 18 and an outer wall 22. Drops of oil collect at the bottom in intermediate chamber sump 38. Some further and similar separation can occur in second separator chamber 24, but the principal purpose of chamber 24 is to provide an area where the turbo oil drain conduit 32 can discharge into the increased cross-section of chamber 24 which slows its velocity and permits the air-oil mixture, which is low in air, to separate. The deaerated oil is pumped from second chamber sump 39 through sump drain conduit 34 by pump 36 and returned to crankcase 12. The air which is separated from the oil passes out through exhaust vent conduit 40 to the outside of the aircraft. The air from inner and intermediate chambers 16 and 20 passes through the perforations in wall 18 and 22 to second chamber 24, thence to upper chamber 26 and to the outside air through exhaust vent conduit 40. The oil that collects in first chamber sump 37 can flow to sump 38 and from sump 38 to sump 39 through the perforations in walls 18 and 22. Oil is recirculated from crankcase 12, through a pump and line not shown, in the conventional manner, through turbo oil supply conduit 31. In case of failure of scavenge pump 36, or some other reason, second chamber 24 fills with oil to the level of exhaust vent conduit 40, and vents oil outboard.

The preferred embodiment with the intermediate separator chamber 20 has been found to operate better than without chamber 20. The perforated walls 18 and 22 have been found to be more efficient than screens or fiber collectors of oil and provide a better path for the descending drops of oil. The location of the first and second chambers can be interchanged, inlets and outlets can be rearranged without departing from the spirit of the invention. The method of separation can also be applied to other than aircraft engines.

Having described the invention with sufficient clarity to enable those familiar with the art to construct and use it, I claim:

1. A duplex air-oil separator for separating two air-oil mixtures of differing proportions from and engine crankcase vent and a turbo-charger oil drain comprising:

a housing;

a first perforated partition wall located within the housing defining first and second separator chambers each having upper portions and sumps at the bottom thereof;

a first conduit means from the engine crankcase vent communicating with the first separator chamber to transmit the air-oil mixtures high in air to the first chamber for separation, a second conduit means from the turbo-charger oil drain communicating with the second separator chamber to transmit air-oil mixtures low in air to the second chamber for separation, an exhaust vent conduit communicating the upper portion of the second chamber to atmosphere, and a sump drain conduit connected to the sump area of the second chamber.

2. A duplex air-oil separator as recited in claim 1, further comprising:

a second perforated partition wall spaced from the first partition wall and said second wall being located in the first separator chamber, the space between the perforated partitions defining an intermediate separator chamber.

3. A duplex air-oil separator as recited in claim 1, wherein the first perforated partition wall is a cylindrical partition centrally spaced within the housing, the area inside the partition defining the first chamber and the area outside the partition defining the second chamber.

4. A duplex air-oil separator as recited in claim 1, wherein the first perforated partition wall is a cylindrical partition closed at the top and bottom, concentrically spaced within the housing, the area inside the partition defining the first chamber and the area outside the partition defining the second chamber.

5. A duplex air-oil separator as recited in claim 1, including a second perforated partition wall spaced outwardly from the first partition wall, both partition walls being cylindrical and concentrically spaced one within the other, both being centrally spaced within the housing, the area inside the first perforated wall defining the first chamber and the area outside the second perforated wall defining the second chamber.

* * * * *